US010583367B1

(12) United States Patent
Sierra

(10) Patent No.: US 10,583,367 B1
(45) **Date of Patent: *Mar. 10, 2020**

(54) GLOVES FOR FORMING A FIGURE

(71) Applicant: David Sierra, San Jose, CA (US)

(72) Inventor: David Sierra, San Jose, CA (US)

( * ) Notice: Subject to any disclaimer, the term of this patent is extended or adjusted under 35 U.S.C. 154(b) by 167 days.

This patent is subject to a terminal disclaimer.

(21) Appl. No.: 14/024,189

(22) Filed: Sep. 11, 2013

Related U.S. Application Data

(63) Continuation of application No. 12/351,546, filed on Jan. 9, 2009, now Pat. No. 8,555,416.

(51) Int. Cl.
*A41D 19/00* (2006.01)
*A63H 33/00* (2006.01)

(52) U.S. Cl.
CPC ..... *A63H 33/00* (2013.01); *A41D 19/0024* (2013.01)

(58) Field of Classification Search
CPC .... A41D 19/01; A41D 27/08; A41D 19/0024; A63H 3/14; A63H 3/02; A63H 33/00
USPC ..... 2/163, 167, 158, 159, 160; 446/71, 76, 446/175, 484, 326, 327, 328, 329, 330, 446/101, 97; D2/610, 613, 615–617, 619, D2/776, 777, 981, 982; D20/29; 381/124
See application file for complete search history.

(56) References Cited

U.S. PATENT DOCUMENTS 1,680,592 A * 8/1928 Chiles ..... 2/158
1,877,940 A * 9/1932 Morgenstern et al. ..... 446/392
2,546,209 A 3/1951 Baum
2,647,195 A 7/1953 Broyles
D189,637 S * 1/1961 Stanton ..... D2/616
3,638,011 A 1/1972 Bain et al.
D268,222 S * 3/1983 Chen ..... D2/615
4,504,240 A * 3/1985 Thomas ..... 446/100
4,687,457 A 8/1987 Milner
4,752,273 A 6/1988 Woods
4,808,139 A * 2/1989 Price ..... 446/75
5,080,626 A * 1/1992 Maddi ..... 446/329
5,177,467 A 1/1993 Chung-Piao
D342,559 S * 12/1993 McGill ..... D21/588
5,322,465 A * 6/1994 McGill ..... 446/100
5,368,518 A * 11/1994 Hitchcock ..... 446/329
D394,288 S * 5/1998 Trahan ..... D21/588
5,762,335 A * 6/1998 Magruder ..... 273/153 R
D404,771 S 1/1999 Palardis
6,012,822 A * 1/2000 Robinson ..... 362/103
D421,465 S 3/2000 Palardis
6,126,507 A 10/2000 Lieberman
6,575,808 B1 6/2003 Wright et al.
(Continued)

FOREIGN PATENT DOCUMENTS

JP 11313984 11/1999

*Primary Examiner* — Anna K Kinsaul
(74) *Attorney, Agent, or Firm* — Haverstock & Owens LLP

(57) ABSTRACT

Gloves for forming a figure are designed to represent a figure such as an animal with one glove forming a first portion of the figure and a second glove forming a second portion of the figure. For example, for a pair of shark gloves, one glove is the top of the shark's mouth with upper teeth and the second glove is the bottom of the shark's mouth with lower teeth. When worn by a user, the user is able to move the two gloves in an open and closed motion so that the shark appears to be opening and biting down. The gloves provide entertainment as well as motivation for the fans and players.

28 Claims, 7 Drawing Sheets

(56) References Cited

U.S. PATENT DOCUMENTS

| | | | | |
|---|---|---|---|---|
| 6,592,235 | B1 | 7/2003 | Mayo | |
| 6,709,142 | B2 * | 3/2004 | Gyori | 362/554 |
| 6,742,913 | B2 | 6/2004 | Deutsch | |
| 6,892,397 | B2 | 5/2005 | Raz et al. | |
| 6,971,943 | B1 | 12/2005 | Schulze | |
| 7,038,575 | B1 | 5/2006 | Frohman et al. | |
| 7,227,965 | B1 * | 6/2007 | Sutton | 381/124 |
| D575,479 | S | 8/2008 | Bengyak | |
| 7,654,682 | B2 | 2/2010 | Denham | |
| D628,767 | S * | 12/2010 | Bengyak | D2/619 |
| 8,555,416 | B1 | 10/2013 | Sierra | |
| 9,211,478 | B1 * | 12/2015 | Bleus | A63H 3/36 |
| 2002/0197960 | A1 * | 12/2002 | Lee et al. | 455/66 |
| 2005/0101220 | A1 * | 5/2005 | Jackson | 446/369 |
| 2006/0104056 | A1 | 5/2006 | O'Brien et al. | |
| 2006/0105671 | A1 | 5/2006 | Conolly | |
| 2007/0253581 | A1 | 11/2007 | Sutton | |
| 2009/0271911 | A1 * | 11/2009 | McKiski | 2/159 |
| 2009/0293166 | A1 | 12/2009 | Shayne | |

* cited by examiner

GLOVES FOR FORMING A FIGURE

CROSS-REFERENCE TO RELATED APPLICATIONS

This application is a continuation application of U.S. patent application Ser. No. 12/351,546, filed on Jan. 9, 2009, and entitled "GLOVES FOR FORMING A FIGURE" which claims the benefit of U.S. Provisional Patent Application Ser. No. 61/010,819, filed Jan. 11, 2008 and entitled "GLOVES FOR FORMING A FIGURE"; which are both hereby incorporated by reference in their entirety for all purposes.

FIELD OF THE INVENTION

The present invention relates to the field of toys/apparel. More specifically, the present invention relates to the field of gloves for forming a figure.

BACKGROUND OF THE INVENTION

At sporting events, people applaud by clapping, waving objects such as towels and performing motions with their hands and arms related to the team's logo/mascot such as the tomahawk chop for the Atlanta Braves™ (a professional baseball team) or the shark bite for the San Jose Sharks™ (a professional hockey team). These efforts by the fans both make the event more entertaining and encourage the team for which the fans are cheering. New ways of enabling fan interaction with the game are constantly sought after.

SUMMARY OF THE INVENTION

Gloves for forming a figure are designed to represent the figure such as an animal with one glove forming a first portion of the figure and a second glove forming a second portion of the figure. For example, for a pair of shark gloves, one glove is the top of the shark's mouth with upper teeth and the second glove is the bottom of the shark's mouth with lower teeth. When worn by a user, the user is able to move the two gloves in an open and closed motion so that the shark appears to be opening and biting down. The gloves provide entertainment as well as motivation for the fans and players.

In one aspect, an apparatus comprises a first covering and a second covering, the first covering and the second covering configured for forming a figure when positioned proximate to each other. The figure is selected from the group consisting of an animal, a plant, a person and a character. The first covering is a first portion of the animal and the second covering is a second portion of the animal. The apparatus further comprises at least one of one or more light sources configured to represent eyes, a memory configured for storing audio and an audio output device for playing the audio. The apparatus further comprises a power source for providing power to at least one of the one or more light sources, the memory and the audio output device. The power source is a solar panel strip. The apparatus further comprises an on/off device configured for turning on at least one of the one or more light sources, the memory, and the audio output device. The on/off device is a motion sensor. The apparatus further comprises an opening in each of the first covering and the second covering, the opening configured for a user's fingers to protrude. The apparatus further comprises an input connector configured for coupling to an audio device.

The audio device is selected from the group consisting of an mp3 player, an iPod® (a portable music player) an iPhone (a smart phone), and a personal digital assistant. The apparatus further comprises a pocket configured for storing the audio device. The apparatus further comprises a coupling mechanism on one of the first covering and the second covering, the coupling mechanism configured for coupling a representative entity to the one of the first covering and the second covering. The first covering and the second covering are selected from the group consisting of gloves, mittens and theatrical gloves.

In another aspect, an apparatus comprises a first glove, a second glove, a first component configured for representing a first portion of an animal, the first component coupled to the first glove, a second component configured for representing a second portion of the animal, the second component coupled to the second glove, the first portion and the second portion configured for forming the animal when positioned proximate to each other. The apparatus further comprises at least one of: one or more light sources configured to represent eyes, a memory configured for storing audio and an audio output device for playing the audio. The apparatus further comprises a power source for providing power to at least one of the one or more light sources, the memory and the audio output device. The power source is a solar panel strip. The apparatus further comprises an on/off device configured for turning on at least one of the one or more light sources, the memory, and the audio output device. The on/off device is a motion sensor. The apparatus further comprises an input connector configured for coupling to an audio device. The audio device is selected from the group consisting of an mp3 player, an iPod®, (a portable music player) an iPhone (a smart phone), and a personal digital assistant. The apparatus further comprises a pocket configured for storing the audio device.

In another aspect, a method of simulating animal motion using gloves comprises positioning the gloves in a first position, positioning the gloves in a second position and repeating the steps. The method further comprises triggering at least one of a visual indicator, and an audio indicator. The gloves comprise a first covering and a second covering, the first covering and the second covering configured for forming an animal when positioned proximate to each other. The gloves further comprise at least one of one or more light sources configured to represent eyes, a memory configured for storing audio and an audio output device for playing the audio.

In another aspect, a shark glove apparatus comprises a first glove configured for representing a first portion of a shark, a second glove configured for representing a second portion of the shark, a plurality of light sources configured for representing eyes on the first glove of the shark, a memory stored within the first glove of the shark; the memory configured for storing audio, an audio component stored within the first glove of the shark, the audio component configured for playing the audio, a power component stored within the first glove of the shark, the power component configured for supplying power to the plurality of light sources, the memory and the audio component and an on/off device stored within the first glove of the shark, the on/off device configured for initiating the plurality of light sources and initiating the audio component to play the audio, the first glove and the second glove configured for forming the shark when positioned proximate to each other.

DETAILED DESCRIPTION OF THE PREFERRED EMBODIMENT

Figure 1A:
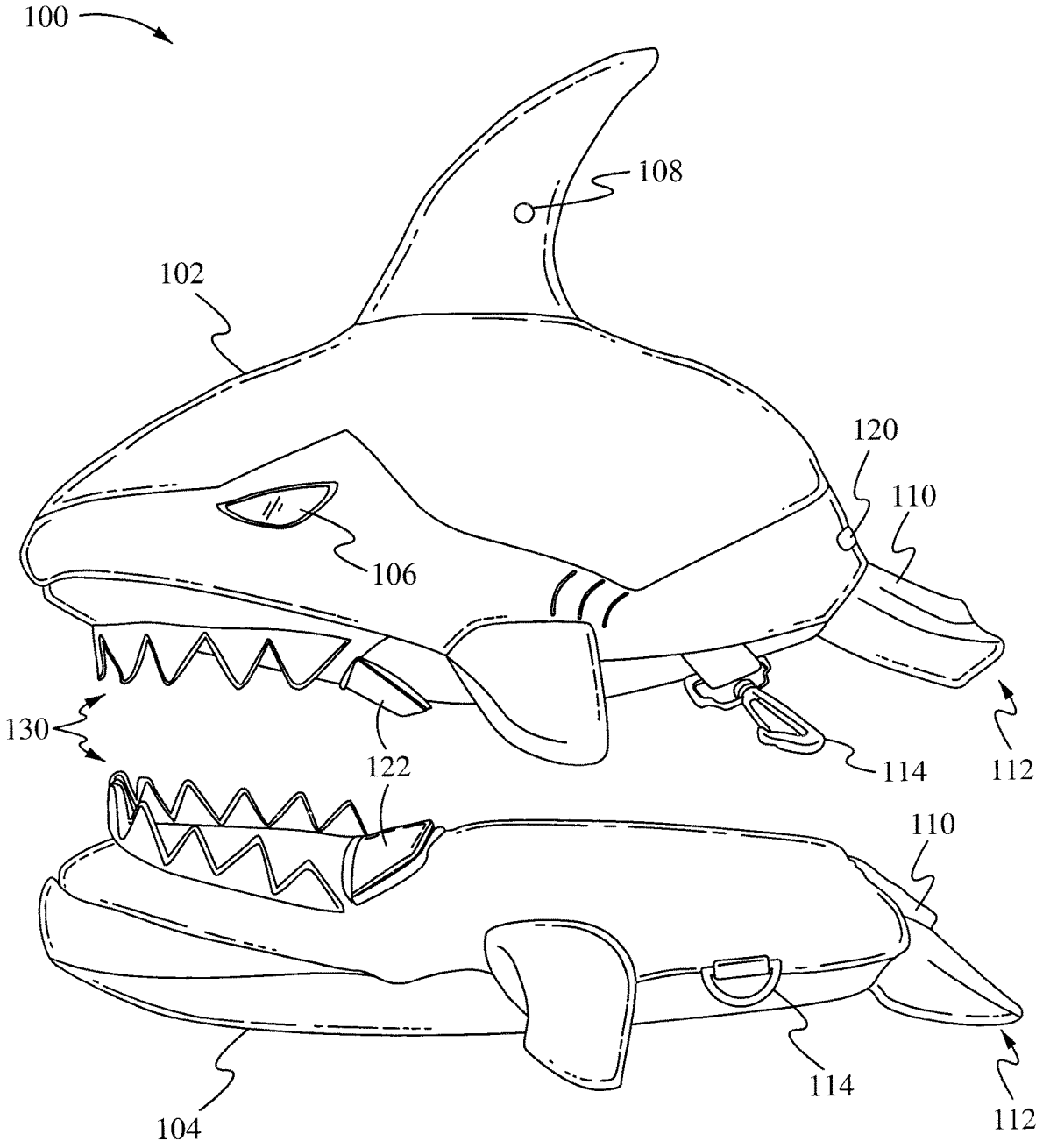
FIG. 1A illustrates a side view of an embodiment of a pair of gloves to form a figure in accordance with the invention.

FIG. 1A illustrates a side view of an embodiment of a pair of gloves 100 to form a figure. The pair of gloves 100 includes a first glove 102 and a second glove 104. In some embodiments, the first glove 102 is a top portion of the figure, and the second glove 104 is a bottom portion of the figure. For example, a pair of shark gloves are shown in FIG. 1A. The first glove 102 is the top of the shark's mouth with upper teeth, and the second glove 104 is the bottom of the shark's mouth with lower teeth. In some embodiments, additional circuitry is included to provide lights, sounds and other effects. A light source 106 such as Light Emitting Diodes (LEDs) is/are positioned to represent eyes of the shark. In some embodiments, components such as eyes and other extras are able to sewn on, glued on or positioned/fastened in any way possible. In some embodiments, the light source 106 is located inside one or both of the gloves, and in some embodiments, the light source 106 is located on the exterior of one or both of the gloves. In some embodiments, an on/off device 108 such as a button is included to activate the eyes and/or play audio such as a theme song (e.g. the theme from the movie Jaws). In some embodiments, the on/off device 108 is located inside one of the gloves, and in some embodiments, the on/off device 108 is located on the exterior of one of the gloves. For example, the on/off device 108 is able to be positioned within the fin of the shark head so that when a user squeezes the fin, the eyes light and/or the audio plays.

Figure 4:
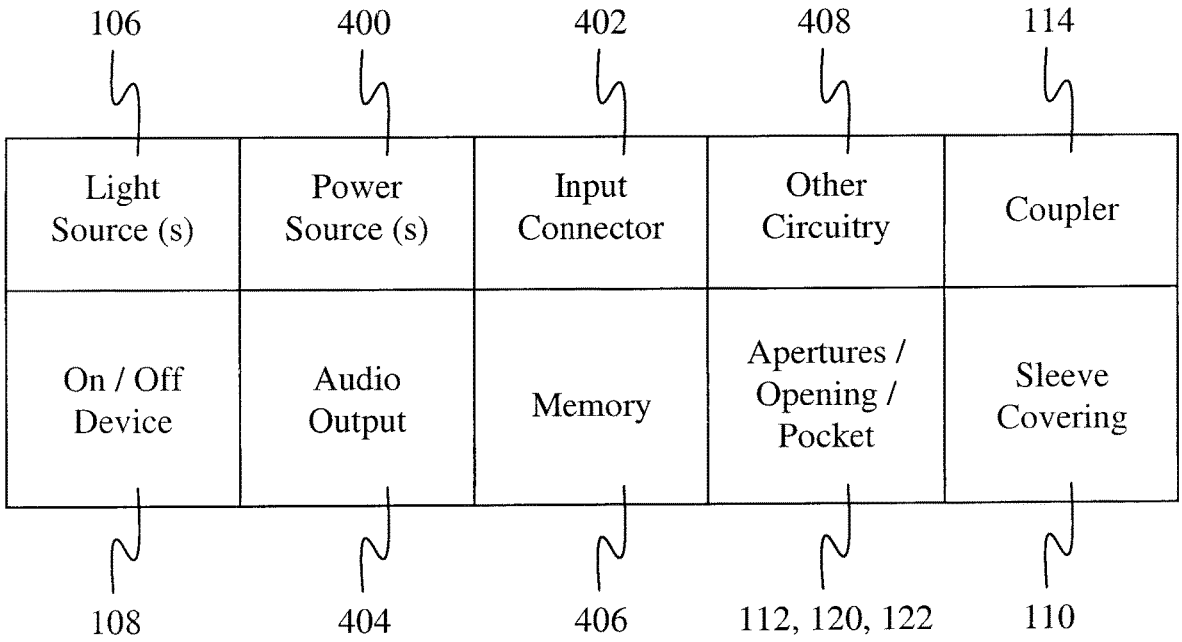
FIG. 4 illustrates a block diagram of an embodiment of a pair of gloves to form a figure in accordance with the invention.

In some embodiments, instead of a button, another type of on/off device is used to light the light source 106 and/or play the audio, such as a switch, lever or a motion sensor which detects a specified movement such as an opening and closing motion. In some embodiments, the light source 106 stays lit, flashes on and off or flashes in a pattern, for a period of time or until a user toggles the on/off device 108 again. In some embodiments, the audio is stored in a memory 406 (FIG. 4) which is positioned on or within the glove and coupled to the on/off device 108. The memory is able to be any type of memory (e.g. flash or EEPROM). The audio is output using an audio output device 404 (FIG. 4) such as a speaker. The audio output device 404 (FIG. 4) is able to be located on or within one or both of the gloves. In some embodiments, in addition to the theme song being played, additional sounds and/or music is able to be stored and played. In some embodiments, a power source 400 (FIG. 4) is coupled to the light source 106 and/or the memory 406 (FIG. 4) and/or the audio output device 404 (FIG. 4). The power source is able to be any of a battery, solar power device/strip, another type of power source or any combination thereof.

In some embodiments, an input connector 402 (FIG. 4) for an audio input device such as an mp3 player, iPod® (a portable music player), iPhone (a smart phone), a personal digital assistant or other audio device is included on or within one or both of the gloves. By coupling the audio input device to the gloves, a user is able to play music stored on the audio input device through the audio output device 404 (FIG. 4) of the gloves or through the audio input device's speakers. For example, a user is able to store all of the fight songs of his favorite sports team on his iPod® (a portable music player), and then play them through the gloves at a sporting event. In some embodiments, a wrist protector 110 couples around a hand opening 112 of each of the gloves. In some embodiments, the gloves have a coupler 114 for coupling the gloves together for storage so that they do not get separated. The coupler 114 is able to be any coupling device such as a clip and loop. In some embodiments, for example for a shark, teeth 130 are included. In some embodiments the teeth 130 are a fabric material, and in some embodiments, the teeth 130 are molded plastic or another material. Although a specific shark figure is shown in FIG. 1A and subsequent figures, the design of the shark figure is able to be modified. For example, the teeth are able to be moved further towards the front so that there is less of a chin.

Figure 1B:
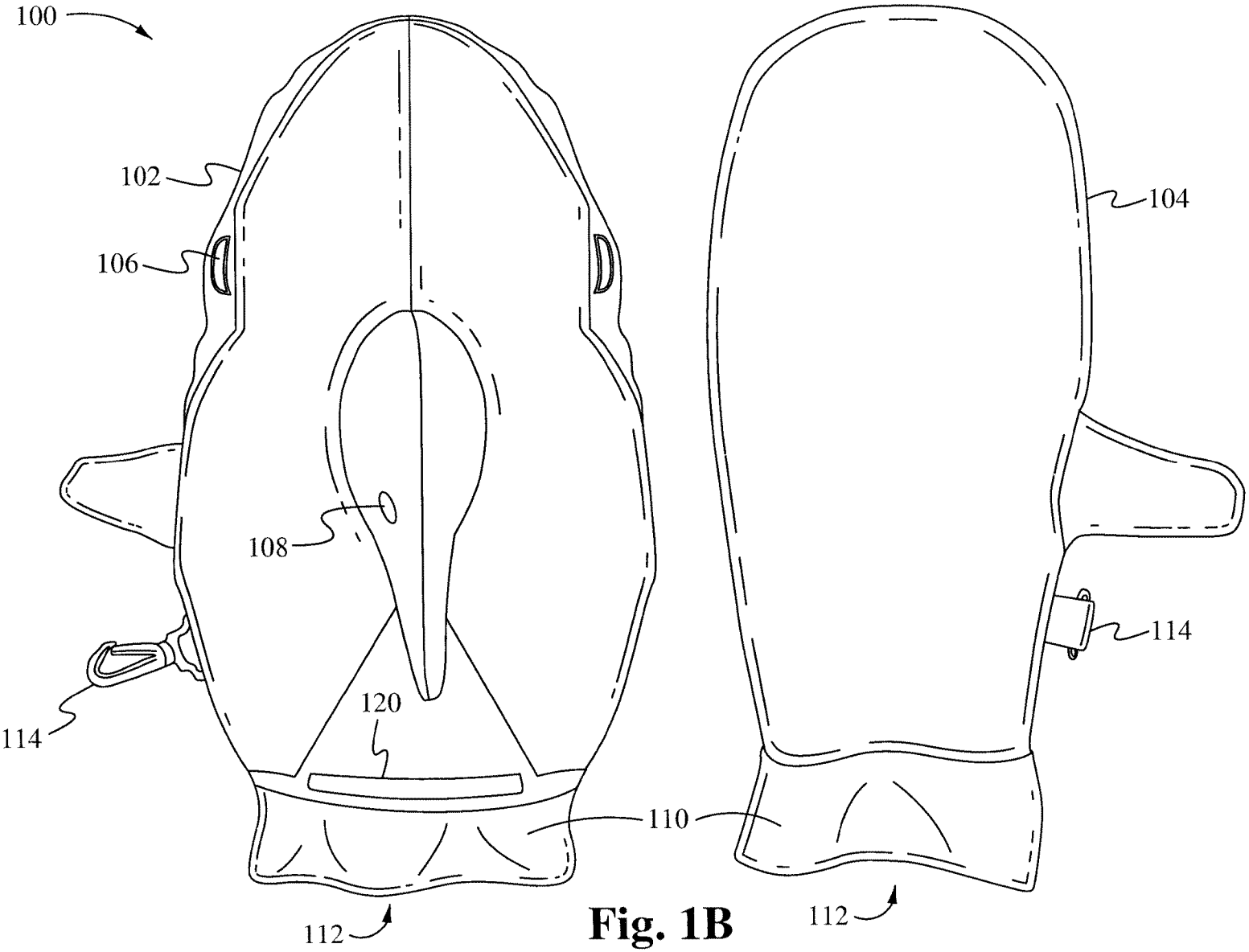
FIG. 1B illustrates a top view of an embodiment of a pair of gloves to form a figure in accordance with the invention.

FIG. 1B illustrates a top view of an embodiment of the gloves 100. As described above, the pair of gloves 100 include the first glove 102 and the second glove 104. In some embodiments, for example, the thumb component of the glove is a fin of a shark. In some embodiments, the eyes include the light source 106, and the on/off device 108 is able to be used to turn on the light source 106. Hand openings 112 allow users to put on the gloves 100. Wrist protectors 110 cover a user's wrists. The coupler 114 enables users to secure the gloves 100 together. In some embodiments, a storage aperture 120 enables a user to access any internal components such as the on/off device 108, the power source 400 (FIG. 4), the light source 106, the memory 406 (FIG. 4), the audio output device 404 (FIG. 4) and the input connector 402 (FIG. 4). In some embodiments, the storage aperture 120 is covered with a flap of material and closed using a closing mechanism such as a hook and loop material (e.g. Velcro®), a zipper, buttons or another closing mechanism. In some embodiments, a pocket is included on or within one or both of the gloves to store the audio input device such as an mp3 player, iPod® (a portable music player), iPhone (a smart phone), a personal digital assistant or other audio device. In some embodiments, the pocket is the inner area of the glove which is accessible through the storage aperture 120.

Figure 1C:
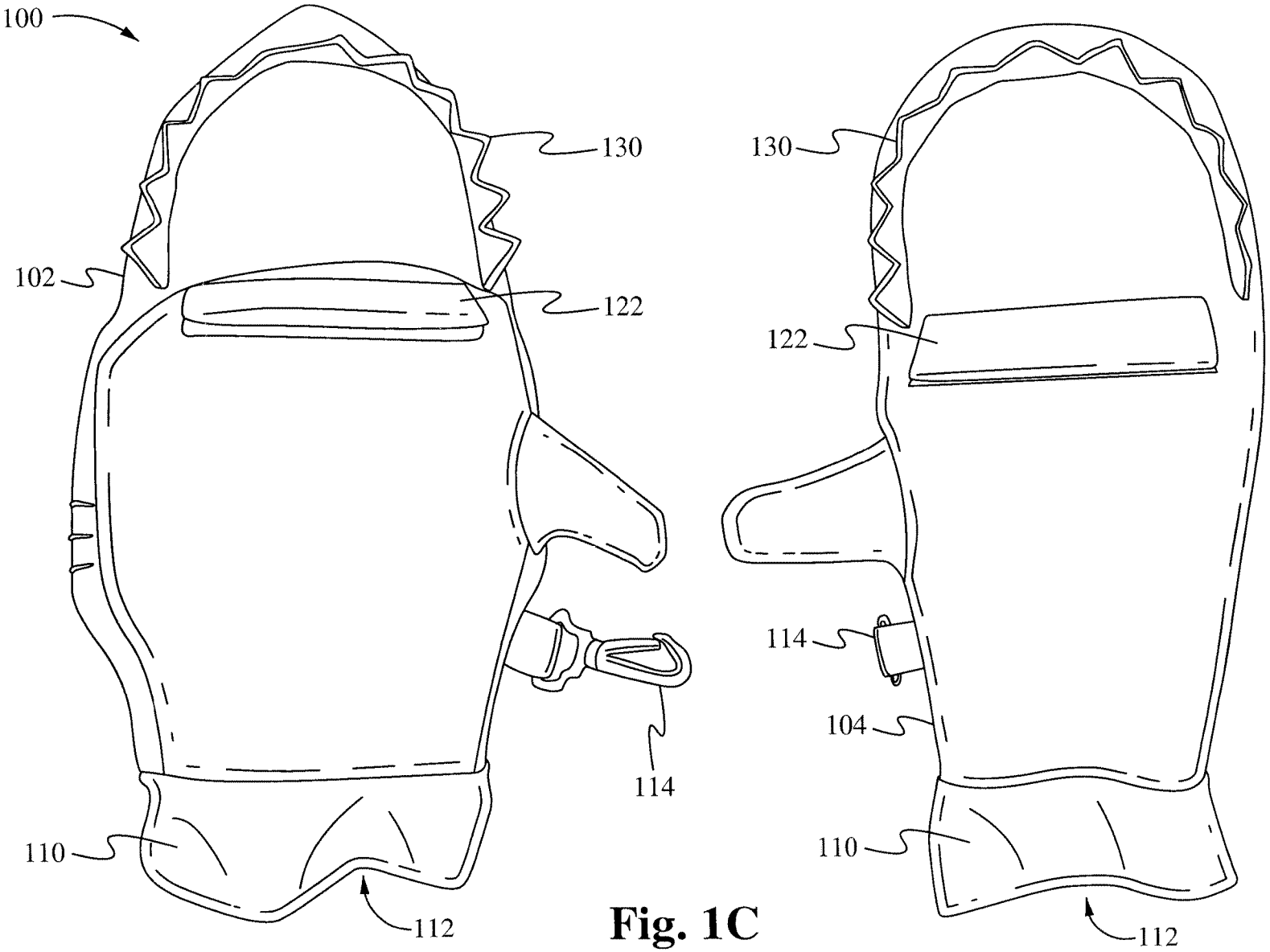
FIG. 1C illustrates a bottom view of an embodiment of a pair of gloves to form a figure in accordance with the invention.

FIG. 1C illustrates a bottom view of an embodiment of the gloves 100. As described above, the pair of gloves 100 include the first glove 102 and the second glove 104. Hand openings 112 allow users to put on the gloves 100. Wrist protectors 110 cover a user's wrists. The coupler 114 enables users to secure the gloves 100 together. In some embodiments, a protrusion aperture 122 in each of the gloves 100 enables a user's fingers to protrude from the gloves 100 to be able to grasp objects easier. In some embodiments, the protrusion aperture 122 is covered with a flap of material and closed using a closing mechanism such as a hook and loop material (e.g. Velcro®), a zipper, buttons or another closing mechanism. As described, the teeth 130 are able to be any material such as a fabric, plastic or something else.

Figure 2:
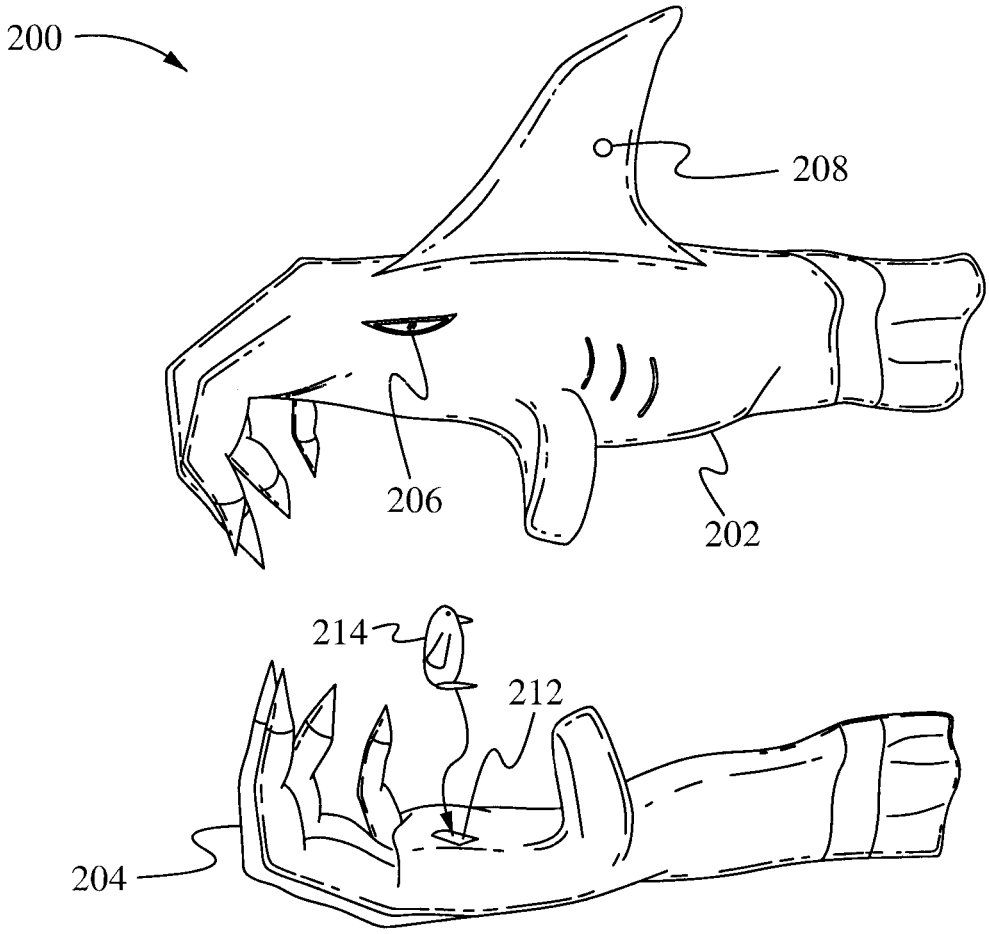
FIG. 2 illustrates a side view of an embodiment of a pair of gloves to form a figure in accordance with the invention.

FIG. 2 illustrates a side view of an embodiment of a pair of gloves 200 to form a figure. The pair of gloves 200 includes a first glove 202 and a second glove 204. Fingers of the gloves 200 are shaped as teeth which fit together as if a shark were biting down. As described above, the gloves 200, or one of the gloves 200, is able to include LEDs 206 to represent eyes with a button 208 and appropriate circuitry to light the LEDs. In some embodiments, a sound module 210 such as speakers and/or a memory is/are also included within or coupled to the gloves 200 to store and emit a sound when desired. The gloves 200 are able to include any components or variations described in the other figures. In some embodiments, a coupling mechanism 212 is included to enable the temporary or permanent coupling of a representative entity 214 to one of the gloves 200. In some embodiments, the coupling mechanism 212 is a hook and loop material such as Velcro®. For example, if the professional sports teams, the San Jose Sharks™ and the Pittsburgh Penguins™ are playing, a user is able to couple a miniature stuffed penguin to the mouth of the shark, so that when the shark biting motion takes place, the shark appears to be biting the penguin. The coupling mechanism 212 and the representative entity 214 are able to be implemented with any of the glove embodiments described herein.

Figure 3:
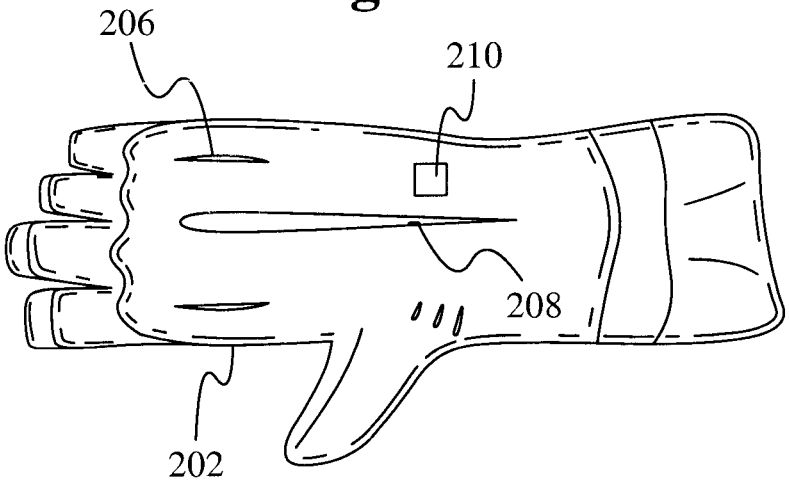
FIG. 3 illustrates a top view of an embodiment of a first glove in accordance with the invention.

FIG. 3 illustrates a top view of a first glove 202 of a pair of gloves 200 to form a figure. As described above, the first glove 202 is a part of a figure which is formed when the first glove 202 is positioned appropriately with the second glove 204 (FIG. 2). In FIG. 3, the first glove 202, is the top part of a shark's head which includes eyes, lit by LEDs 206 and a fin. A button 208 is able to be included to turn the LEDs on and off.

FIG. 4 illustrates a block diagram of components of any of the gloves described herein. Any number of components are able to be included. For example, all of the components are able to be included, or a selected number of components are included. Some of the components are located within the glove and some are located on the outer part of the glove. The gloves include an outer covering and in some embodiments, inner stuffing as well. As described above, components of the gloves include light source(s) 106, an on/off device 108, power source(s) 400, an input connector 402, audio output device 404, memory 406, other circuitry 408, apertures/openings 112, 120, 122, a coupler 114 and a wrist covering 110. Additional items are also able to be included.

Figure 5:
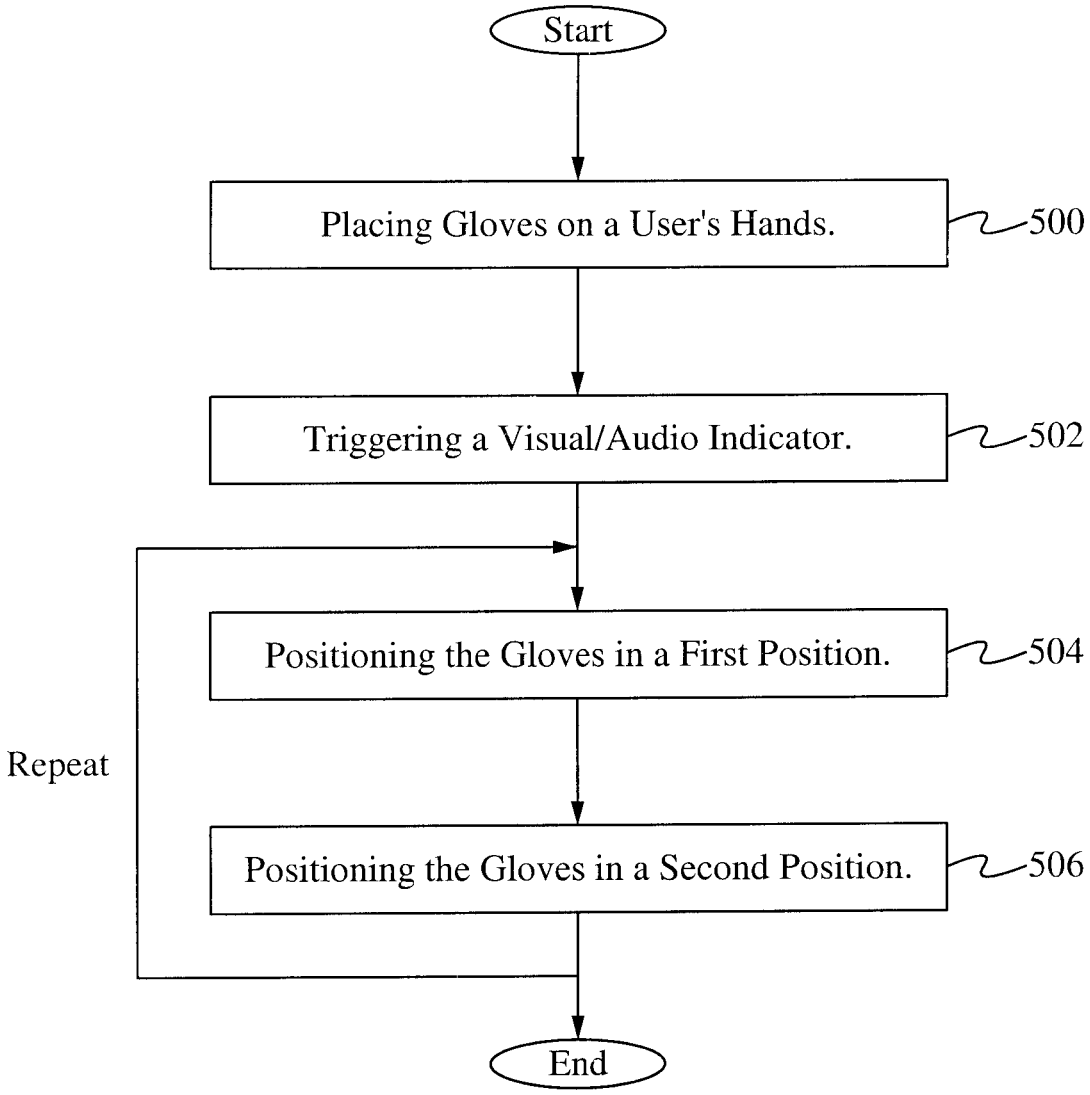
FIG. 5 illustrates a flowchart of a method of using the gloves to form a figure in accordance with the invention.

FIG. 5 illustrates a flowchart of a method of using the gloves to form a figure. In the step 500, the user puts the gloves on. In the step 502, in some embodiments, the user triggers a visual and/or audio indicator such as flashing eyes and a sound or music using an on/off device. In the step 504, the user positions the gloves in a first position. For example, the user places a shark's upper jaw on top of the shark's lower jaw similar to a close-mouthed shark. In the step 506, the user positions the gloves in a second position. For example, the user moves the shark's upper jaw away from the shark's lower jaw similar to an open-mouthed shark. The user then repeats steps 504 and 506 to represent a repeated motion such as shark bites. The steps are able to occur in varying orders. For example, a user is able to completely skip step 502. Also, a user is able to trigger the visual and/or audio indicator before putting on the gloves. In some embodiments, there are additional positions that the gloves are positioned into beyond a second position. In some embodiments, triggering the visual and/or audio indicator includes coupling an audio input device such as an iPod® (a portable music player) to the gloves through the connector as described above. In some embodiments, a user places a representative entity within the gloves such as an opponent's mascot.

Figure 6:
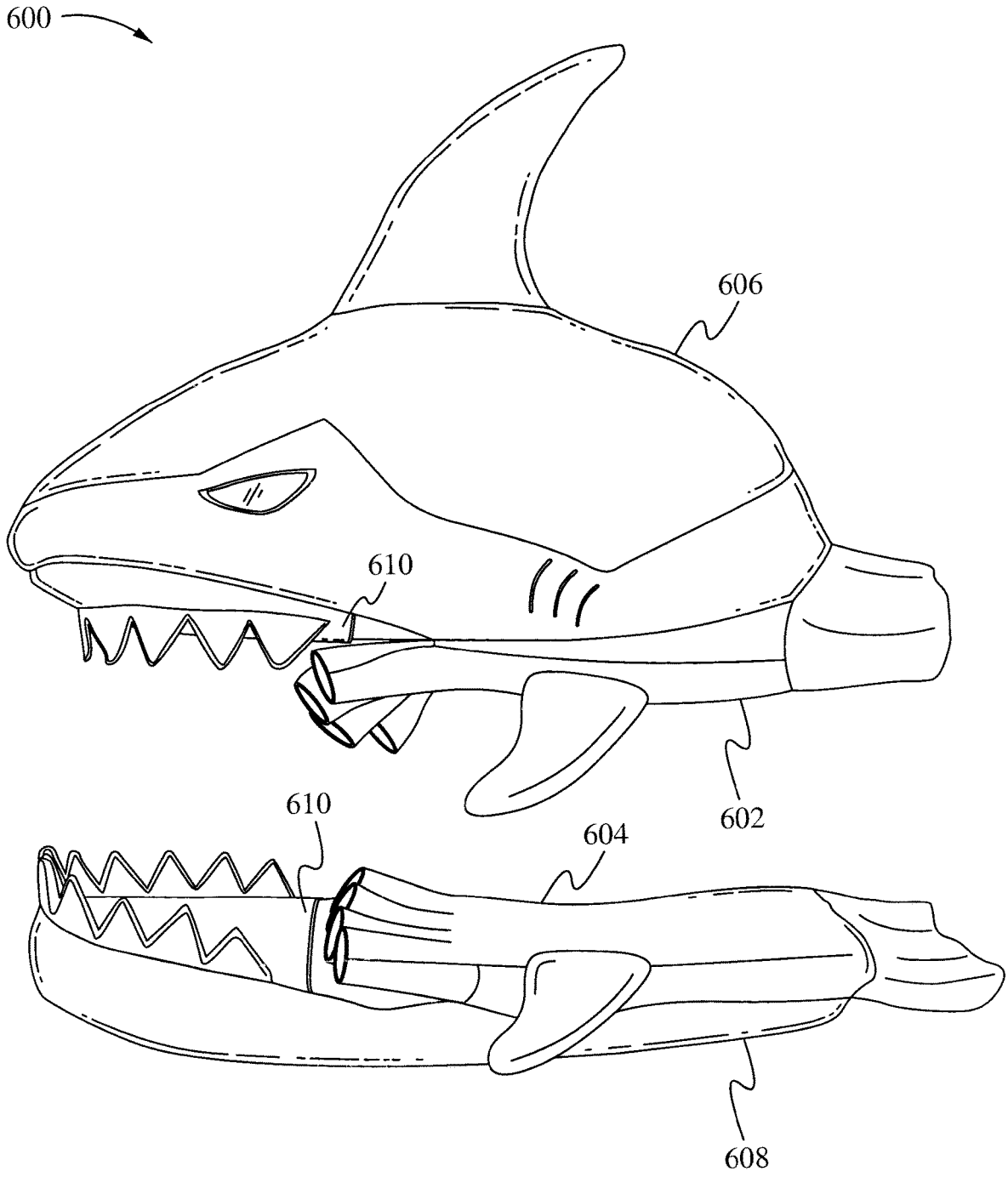
FIG. 6 illustrates a side view of an embodiment of a pair of gloves to form a figure in accordance with the invention.

FIG. 6 illustrates a side view of an embodiment of a pair of gloves 600 to form a figure. The gloves 600 include a first theatrical glove 602 and a second theatrical glove 604. A first component 606 is coupled to the first theatrical glove 602, and a second component 608 is coupled to the second theatrical glove 604. The first component 606 and the second component 608 are able to be designed in any desired shape. For example, the first component 606 is able to be the top part of a shark's head and the second component 608 is able to be the bottom part of a shark's head. The first theatrical glove 602 and the second theatrical glove 604 are configured such that they blend in with the first component 606 and the second component 608. For example, if the part of the first component 606 and the second component 608 that touches the first theatrical glove 602 and the second theatrical glove 604 is black, then the first theatrical glove 602 and the second theatrical glove 604 are black making it difficult to distinguish the gloves from the components.

The first theatrical glove 602 and the second theatrical glove 604 are able to be coupled to the first component 606 and the second component 608 in any manner, for example, by sewing, a hook and loop material, or any other implementation. In some embodiments, the first component 606 and the second component 608 are detachable from the first theatrical glove 602 and the second theatrical glove 604. In some embodiments, the gloves are full-fingered gloves covering a user's entire hand and fingers. In some embodiments, the fingers of the gloves are cutoff roughly half-way to allow the user's fingers to protrude out of the gloves. In some embodiments, a pocket 610 is positioned on the first component 606 and the second component 608 to receive the user's fingers. In some embodiments, additional aspects are included in the first component 606 and/or the second component 608 such as light source(s) 106 (FIG. 1A), an on/off device 108 (FIG. 1A), power source(s) 400 (FIG. 4), an input connector 402 (FIG. 4), audio output device 404 (FIG. 4), memory 406 (FIG. 4), other circuitry 408 (FIG. 4), a storage aperture 120 and a coupler (FIG. 1A), as described above. In some embodiments, other items such as a wrist covering 110 (FIG. 1A), the coupling mechanism 212 (FIG. 2) and the representative entity 214 (FIG. 2) are also included. Additional items are also able to be included.

The pair of gloves are constructed of any appropriate material to form gloves. In some embodiments, the gloves are constructed of leather, vinyl or polyvinyl chloride (PVC). In some embodiments, the gloves are constructed of a plush fabric. In some embodiments, the gloves are constructed of a waterproof material. In some embodiments, the gloves include insulation to protect from cold, while in other embodiments, the gloves are indoor gloves and added insulation is not necessary. The gloves are sized appropriately to fit on a user's hands.

As described above, the gloves are designed to form a figure when put together or represent a figure when together or apart. The gloves are able to form part or all of an animal, a person or another object. In some embodiments, the gloves are also designed so that the gloves illustrate an action when each of the gloves is moved in a certain way. Using the shark example, since the first glove is the upper jaw and the second glove is the lower jaw, when a user moves his/her arms in an opening/closing motion, it appears that the shark is opening and closing his mouth to bite an object. A similar example includes a gator design where the upper and lower jaws are the two gloves and a chomping motion is mimicked when a user moves his hands properly.

To utilize the gloves for forming a figure, a user wears the gloves as he/she would wear any pair of gloves. Then, the user positions the gloves to form a figure, such as by placing one glove on top of the other and/or interlocking the fingers of each glove. For example, the upper jaw of one glove is placed above the lower jaw of the other glove. To emulate the figure in action, the user moves his/her gloves in an appropriate motion such as spread apart vertically and then closed together repeatedly. For example, a user is able to simulate a shark opening and closing its mouth by separating and closing his/her arms vertically.

In operation, the gloves for forming a figure allow a user to mimic the actions of the entity the gloves represent. Furthermore, the gloves appear similar to the entity when positioned appropriately. For example, the two gloves of shark jaws appear mildly similar to a shark when apart, but when together, it is very clear that the gloves form a shark head. Furthermore, the gloves are able to maintain warmth while providing entertainment for the user.

The gloves are not limited to being used at a sporting event and are able to be used anywhere. For example, children are able to utilize the gloves to play a game of hunter animals and prey where some children wear gloves of hunters such as sharks and crocodiles, and other children wear gloves of prey such as fish who try to swim away from the hunters.

As used herein, the term gloves includes gloves with separate finger slots, mittens with a thumb slot and a large slot for four fingers, mittens with a thumb slot and two slots which each fit two fingers and other hand-worn coverings.

Although sharks for the San Jose Sharks™ (a professional hockey team), have been described as a possible figure, other figures are possible, including but not limited to, lions, bengals, bears, eagles, diamondbacks, hawks, gators, penguins, giants, any real or fictional animals, any real or fictional plants and any real, fictional people/characters and any real or fictional objects. Furthermore, the representation does not have to be based on an opening and closing of a mouth. Other motions are possible such as a side-to-side motion/clapping motion, a swimming motion, a flying motion and many other possible motions.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. An apparatus comprising:

a. a first covering for wearing on a first hand, the first covering comprising a first fingers slot and a first thumb slot, different from the first fingers slot, the first covering comprising a first head portion, the first head portion comprising a set of eyes and a set of teeth and a first body portion of a figure, the first body portion comprising a first appendage extending from the first body portion; and b. a second covering separable from the first covering for wearing on a second hand, the second covering comprising a second fingers slot and a second thumb slot, different from the second fingers slot, the second covering comprising a second head portion and a second body portion of the figure, the second body portion comprising a second appendage different from the first appendage and extending from the second body portion, wherein the figure comprises a head and a body, the first covering and the second covering forming all of the head and the body of the figure when positioned proximate to each other, independent a separate movement of the first covering and the second covering and wherein the first covering and the second covering are separable to indicate a movement of the figure.

2. The apparatus of claim 1 wherein the figure is selected from the group consisting of an animal, a person and a character.

3. The apparatus of claim 1 further comprising at least one of:

a. one or more light sources configured to represent eyes;

b. a memory configured for storing audio; and c. an audio output device for playing the audio.

4. The apparatus of claim 3 further comprising a power source for providing power to at least one of the one or more light sources, the memory and the audio output device.

5. The apparatus of claim 4 wherein the power source is a solar panel strip.

6. The apparatus of claim 3 further comprising an on/off device configured for turning on at least one of the one or more light sources, the memory, and the audio output device.

7. The apparatus of claim 6 wherein the on/off device is a motion sensor.

8. The apparatus of claim 1 further comprising an opening in each of the first covering and the second covering, the opening configured for a user's fingers to protrude.

9. The apparatus of claim 1 further comprising an input connector configured for coupling to an audio device.

10. The apparatus of claim 9 wherein the audio device is selected from the group consisting of an mp3 player, a portable music player, a smartphone, and a personal digital assistant.

11. The apparatus of claim 9 further comprising a pocket configured for storing the audio device.

12. The apparatus of claim 1 further comprising a coupling mechanism on one of the first covering and the second covering, the coupling mechanism configured for coupling a representative entity to the one of the first covering and the second covering.

13. The apparatus of claim 1 wherein the first covering and the second covering are selected from the group consisting of gloves, mittens and theatrical gloves.

14. An apparatus comprising:

a. a first glove for wearing on a first hand, the first glove comprising a first fingers slot and a first thumb slot, different from the first fingers slot;

b. a second glove separable from the first glove for wearing on a second hand, the second glove comprising a second fingers slot and a second thumb slot, different from the first fingers slot;

c. a first component configured for representing a first portion of an animal and comprising a first animal head portion, the first head portion comprising a set of eyes and a set of teeth and a first animal body portion, the first animal body portion comprising a first appendage extending from the first animal body portion, and the first component coupled to the first glove; and d. a second component configured for representing a second portion of the animal and comprising a second animal head portion and a second animal body portion, the second animal body portion comprising a second appendage different from the first appendage and extending from the second body portion, and the second component coupled to the second glove;

wherein the first portion and the second portion are three-dimensional and configured for forming all of the head and the body of the animal when the first glove and the second glove are positioned next to each other, independent of a separate movement of the first component and the second component.

15. The apparatus of claim 14 further comprising at least one of:

a. one or more light sources configured to represent eyes;

b. a memory configured for storing audio; and c. an audio output device for playing the audio.

16. The apparatus of claim 15 further comprising a power source for providing power to at least one of the one or more light sources, the memory and the audio output device.

17. The apparatus of claim 16 wherein the power source is a solar panel strip.

18. The apparatus of claim 15 further comprising an on/off device configured for turning on at least one of the one or more light sources, the memory, and the audio output device.

19. The apparatus of claim 18 wherein the on/off device is a motion sensor.

20. The apparatus of claim 14 further comprising an input connector configured for coupling to an audio device.

21. The apparatus of claim 20 wherein the audio device is selected from the group consisting of an mp3 player, a portable music player, a smartphone, and a personal digital assistant.

22. The apparatus of claim 20 further comprising a pocket configured for storing the audio device.

23. A shark glove apparatus comprising:

a. a first glove for wearing on a first hand, the first glove having a first element configured for representing a first portion of a shark and comprising a first shark head portion and a first shark body portion, the first shark body portion comprising a first appendage extending from the first shark body portion;

b. a second glove for wearing on a second hand, the second glove having a second element configured for representing a second portion of the shark and comprising a second shark head portion and a second shark body portion, the second shark body portion comprising a second appendage different from the first appendage and extending from the second shark body portion, wherein the second glove is separable from the first glove;

c. a plurality of light sources representing eyes on the first glove of the shark;

d. a memory stored within the first glove of the shark, the memory for storing audio;

e. an audio output component coupled to the memory and stored within the first glove of the shark, the audio output component for playing the audio;

f. a power component coupled to the plurality of light sources, the memory and the audio output component and stored within the first glove of the shark, the power component for supplying power to the plurality of light sources, the memory and the audio component; and g. an on/off device stored within the first glove of the shark, the on/off device configured for initiating the plurality of light sources and initiating the audio component to play the audio;

wherein the first element and second element are three-dimensional and configured for forming all of the shark when positioned proximate to each other.

24. An apparatus comprising:

a. a first glove with a plurality of slots for a finger or a thumb for wearing on a first hand;

b. a second glove with a plurality of slots for a finger or a thumb and separable from the first glove for wearing on a second hand;

c. a first component representing a first portion of an animal, the first component comprising a first animal appendage extending from the first portion and coupled to the first glove wherein the first glove also comprises a set of eyes and a set of teeth; and d. a second component representing a second portion of the animal, the second portion comprising a second animal appendage, different from the first appendage extending from the second component and coupled to the second glove;

wherein the first portion and the second portion are three-dimensional and configured for forming all of the animal when the first glove and the second glove are positioned next to each other, independent of a separate movement of the first component and the second component, and wherein the first glove and the second glove are separable to indicate a movement of a mouth of the animal.

25. An animal glove apparatus comprising:

a. a first glove with a plurality of slots for a finger or a thumb for wearing on a first hand;

b. a second glove with a plurality of slots for a finger or a thumb for wearing on a second hand;

c. a first component coupled to the first glove and representing a first portion of an animal, the first portion comprising a set of eyes and a first set of teeth;

d. a second component coupled to the second glove and representing a second portion of the animal, the second portion comprising a second set of teeth;

wherein the first portion and the second portion are three-dimensional and configured for forming an animal head when the first glove and the second glove are positioned next to each other, independent of a separate movement of the first component and the second component, and wherein the first glove and the second glove are separable to indicate a movement of a mouth of the animal.

26. The animal glove apparatus of claim 25, wherein the animal comprises a shark.

27. The animal glove apparatus of claim 25, wherein the animal comprises an alligator.

28. The animal glove apparatus of claim 25, wherein the animal comprises a bear.

* * * * *